US007690187B2

(12) United States Patent
Bekey

(10) Patent No.: US 7,690,187 B2
(45) Date of Patent: Apr. 6, 2010

(54) MODULAR MICROPROPULSION DEVICE AND SYSTEM

(75) Inventor: Ivan Bekey, Annandale, VA (US)

(73) Assignee: The Aerospace Corporation, El Segundo, CA (US)

( * ) Notice: Subject to any disclaimer, the term of this patent is extended or adjusted under 35 U.S.C. 154(b) by 781 days.

(21) Appl. No.: 11/527,133

(22) Filed: Sep. 26, 2006

(65) Prior Publication Data

US 2008/0072565 A1 Mar. 27, 2008

(51) Int. Cl.
*F03H 1/00* (2006.01)
*H05H 1/00* (2006.01)

(52) U.S. Cl. ..... 60/202; 60/203.1

(58) Field of Classification Search ..... 60/202, 60/203.1
See application file for complete search history.

(56) References Cited

U.S. PATENT DOCUMENTS 4,825,646 A * 5/1989 Challoner et al. ..... 60/202
4,838,021 A * 6/1989 Beattie ..... 60/202
5,239,820 A * 8/1993 Leifer et al. ..... 60/202
5,269,131 A * 12/1993 Brophy ..... 60/202
5,359,180 A * 10/1994 Park et al. ..... 219/121.54
5,369,953 A * 12/1994 Brophy ..... 60/202
5,646,476 A * 7/1997 Aston ..... 313/359.1
5,819,526 A * 10/1998 Jackson et al. ..... 60/203.1
5,924,277 A * 7/1999 Beattie et al. ..... 60/202
5,947,421 A * 9/1999 Beattie et al. ..... 244/171.1
6,182,441 B1 * 2/2001 Hosick ..... 60/202
6,216,445 B1 * 4/2001 Byers et al. ..... 60/203.1
6,318,069 B1 * 11/2001 Falce et al. ..... 60/202
6,378,290 B1 * 4/2002 Killinger et al. ..... 60/202
6,378,292 B1 * 4/2002 Youngner ..... 60/224
6,448,721 B2 * 9/2002 Raitses et al. ..... 315/501
6,487,844 B1 * 12/2002 Lohn et al. ..... 60/200.1
6,539,703 B1 * 4/2003 Lohn et al. ..... 60/203.1
6,619,028 B2 * 9/2003 Kreiner et al. ..... 60/202
6,696,792 B1 * 2/2004 Foster ..... 315/111.21
6,769,241 B2 * 8/2004 Spanjers et al. ..... 60/203.1
6,892,525 B2 * 5/2005 Guiheen et al. ..... 60/200.1
6,996,972 B2 * 2/2006 Song ..... 60/202
7,053,558 B2 * 5/2006 Hilbers et al. ..... 315/169.1
7,269,940 B2 * 9/2007 Wiseman ..... 60/202
7,454,893 B2 * 11/2008 Bossmann et al. ..... 60/202
7,509,795 B2 * 3/2009 Allen ..... 60/202
7,516,610 B2 * 4/2009 Gilchrist et al. ..... 60/202
7,544,260 B2 * 6/2009 Banister et al. ..... 149/2
7,621,115 B2 * 11/2009 Furukawa ..... 60/202
2003/0226750 A1 * 12/2003 Fenn ..... 204/164
2005/0257515 A1 * 11/2005 Song ..... 60/202
2007/0033920 A1 * 2/2007 Song ..... 60/202
2007/0056262 A1 * 3/2007 Leach et al. ..... 60/204
2008/0251735 A1 * 10/2008 Putterman et al. ..... 250/424
2009/0120056 A1 * 5/2009 Friedberger et al. ..... 60/203.1

* cited by examiner

*Primary Examiner*—William H Rodríguez
(74) *Attorney, Agent, or Firm*—Sutherland Asbill & Brennan LLP

(57) ABSTRACT

A modular propulsion system includes an array of micromachined field effect electrostatic propulsion devices, each of which is an assembled micromachined device including an array of field effect electrostatic propulsion thrusters, a fuel container of propellant using passive plumbing, electronic power and command controls, with the array of devices disposed about and on a surface of a spacecraft for providing diverse propulsion needs.

20 Claims, 2 Drawing Sheets

MODULAR MICROPROPULSION DEVICE

MODULAR MICROPROPULSION DEVICE

MODULAR MICROPROPULSION SYSTEM

MODULAR MICROPROPULSION DEVICE AND SYSTEM

STATEMENT OF GOVERNMENT INTEREST

The invention was made with Government support under contract No. FA8802-00-C-0001 by the Department of the Air Force. The Government has certain rights in the invention.

FIELD OF THE INVENTION

The invention relates to the field of propulsion devices and systems. More particularly, the present invention relates to modular micropropulsion devices and systems using micron-sized field effect electrostatic propulsion thrusters well suited for controlling spacecraft.

BACKGROUND OF THE INVENTION

Developmental space propulsion systems have used macro field effect electrostatic propulsion thrusters that have sub-millimeter to millimeter-sized gaps to create large ion accelerating fields with smaller applied voltages than is possible with conventional ion thrusters, which typically require many thousands of volts. The resulting macro thrusters have a large specific impulse and have a large thrust. However, macro field effect electrostatic propulsion thrusters do require accelerating voltages of many hundreds to a thousand or more volts, which is undesirable. These macro field effect electrostatic propulsion thrusters have been built and tested for use in space but lack possible further reductions in size and weight. These macro field effect electrostatic propulsion thrusters have not been micromachined with micron dimensions, and thus, the size of propulsion arrays using the thrusters will necessarily be large.

In contrast to the macro field effect electrostatic propulsion, micromachined field effect electrostatic propulsion thrusters are in development. The micromachined field effect electrostatic propulsion thrusters are made with accelerating gaps whose dimensions are in micrometer sizes. These micromachined thrusters and arrays made of these micromachined thrusters are the only known space propulsion technology capable of simultaneously providing high specific impulse from 500 to 5,000 seconds, high thrust in micronewtons to Newtons, low specific weight in grams/Newton of thrust, lower specific power demands than conventional electric ion propulsion in N/kW, and much lower required drive voltages in the range of 200-500 V rather than the many thousands of volts for conventional ion thrusters. In addition, these micromachined thrusters have the ability to control the thrust proportionally from nanonewtons to Newtons.

The macromachined field effect electrostatic propulsion thrusters take advantage of micromachined designs using a hollow accelerating electrode with a self-forming cone of liquid metal propellant, such as one made of gallium or indium. The tip radius of this cone forms to radii in the nanometer scale. Thus, the field required to pull ions out of the liquid and accelerate the ions is very low due to a very large field gradient. The accelerating voltage varies both with the desired specific impulse $I_{sp}$ and the material to be ionized. For example, preliminary consideration would indicate that specific impulses of 3,000 $I_{SP}$ could be attained using liquid indium with a potential difference of about 500 volts, and for liquid gallium, the potential difference would be only about 300 volts. These thrusters have high efficiency. This high efficiency, from 500 to 5,000 seconds, indicates that a given thrust should be obtainable with about half the input power than is the case for conventional ion propulsion.

In addition, the micro thruster weight becomes negligible when micromachined on a silicon or other substrate. As an example, initial calculations suggest that a 1 mm by 1 mm array with $10^5$ micron-sized ion sources should produce a thrust level of 7.2 mN at a specific impulse of 1,700 seconds with an ion beam power of only 60 W. Also, because the ionization time constants are extremely short, proportionally variable thrust over a very large thrust range can be achieved by simply pulse-modulating the impressed accelerating voltage.

Prior space thrusters, such as gas thrusters, have been employed in arrays for providing directional microthrust. However, field effect electrostatic propulsion thrusters have not been developed to provide space systems with efficient directional microthrust propulsion and control. Prior space thrusters have required fuel plumbing, valving, pressurants, and external tanks, to perfect the delivery of propellants to the space thrusters. Such fuel plumbing, valving, pressurants, and external tanks in the macroscale for system applications have been unsuitable for use with field effect electrostatic propulsion micromachined thrusters. These and other disadvantages are solved or reduced using the invention.

SUMMARY OF THE INVENTION

An object of the invention is to provide a modular device comprising an array of field effect electrostatic propulsion thrusters.

Another object of the invention is to provide a modular micromachined device comprising an array of modular field effect electrostatic propulsion thrusters.

Another object of the invention is to provide a modular device comprising an array of field effect electrostatic propulsion thrusters having data, command, and power communications.

Yet another object of the invention is to provide a modular device comprising an array of modular field effect electrostatic propulsion thrusters having power supplied through solar cells.

Still another object of the invention is to provide a modular micromachined device comprising an array of modular field effect electrostatic propulsion thrusters having respective propellant containers.

A further object of the invention is to provide a propulsion system comprising an array of modular micromachined devices each comprising an array of field effect electrostatic propulsion thrusters.

Still a further object of the invention is to provide a propulsion system comprising an array of modular devices each comprising an array of field effect electrostatic propulsion thrusters with each device having respective command, data, and power communications.

Yet a further object of the invention is to provide a propulsion system comprising an array of micromachined modular devices each comprising an array of field effect electrostatic propulsion thrusters with each device having a respective heat sink contact coupled to a heat sink.

Yet another object of the invention is to provide a propulsion system comprising an array of micromachined modular devices each comprising an array of field effect electrostatic propulsion thrusters with each device having a self contained propellant container including a passive means for drawing the propellant to each of the field effect electrostatic propulsion thrusters.

The invention is directed toward a modular propulsion system including modular devices each comprising an array of micromachined field effect electrostatic propulsion devices. The modular propulsion system includes packaged micromachined field effect electrostatic propulsion devices disposed in an array about a spacecraft for providing diverse propulsion capabilities. The propulsion system includes an array of propulsion devices each having an array of field effect electrostatic propulsion thrusters that have micromachined micron-sized gaps to create very large ion accelerating fields with small applied voltages to provide large specific impulse and large thrust simultaneously, yet be very small and lightweight. The array of micromachined field effect electrostatic propulsion thrusters and supporting electronics and fuel container are integrated within the device that can be in any compact shape, such as a cube, for high density array disposition about the surface of a spacecraft.

The system of array of devices provides accumulated thrust as needed and in directions as assembled and disposed about an exterior surface of the spacecraft as a wide area propulsion system that at a minimum includes command communications for communicating commands from a system controller to the devices of the array of devices. Each of the devices in the array of devices may also communicate data to a system controller by data communications. The command and data communications between the system controller and the array of devices can be by hardwired links using conductor runs or electromagnetic transmission using system and device antennas. Power delivered to the array of thrusters of each device can be generated locally through the use of solar cells or batteries disposed on the device. Each device may further include power converters, data processors, command decoders, power contacts, data communication contacts, and heat sink contacts. The device could also include a battery supply. At a minimum, the device must include a micromachined thruster array, a fuel supply with passive plumbing, and a means for delivering electrical power to the thruster array, and a control means for controlling the thrust of the thruster array. As such, the devices are self-contained modular packages. Further, such a device operates without active plumbing and valves. The device may further operate without a fuel pressurant. Additionally, the devices do not require external fuel tanks. The devices are compact in shape and can be attached or bonded to spacecraft surfaces for accumulated aggregate thrust about the spacecraft as needed. The devices have low weight and can be inexpensively mass-produced. The devices deposed in a wide area system as an array of devices can satisfy various and largely varied spacecraft propulsion needs. Any number of devices can be used without device redesign for many applications requiring larger or smaller thrust due to the inherent modular design of the devices. These and other advantages will become more apparent from the following detailed description of the preferred embodiment.

DETAILED DESCRIPTION OF THE PREFERRED EMBODIMENT

Figure 1:
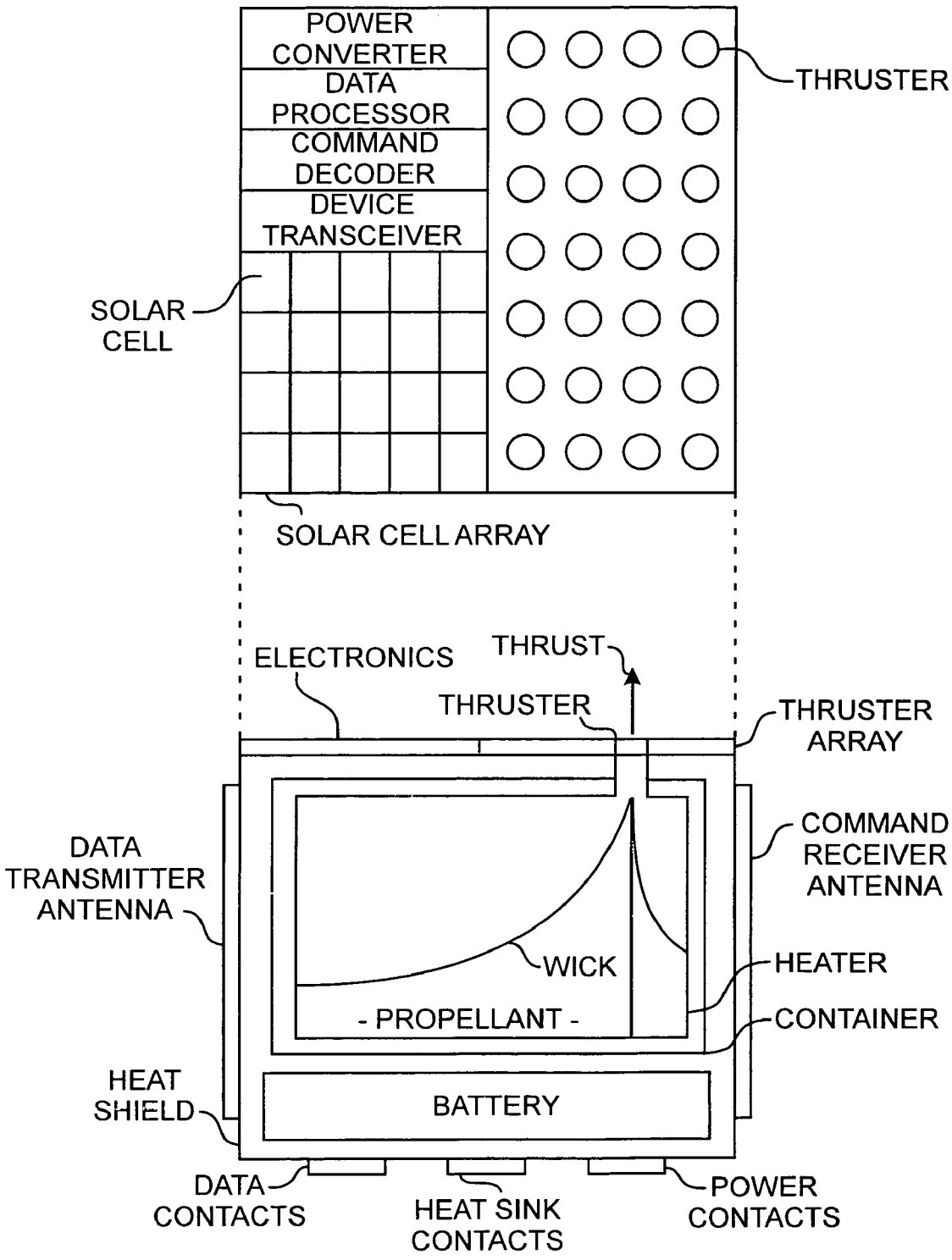
FIG. 1 depicts a modular micropropulsion device.

An embodiment of the invention is described with reference to the figures using reference designations as shown in the figures. Referring to FIG. 1, a modular micropropulsion device is preferably fashioned in the shape of a cube having on a top surface of electronics comprising a power converter, a data processor, a command decoder, a device transceiver, and a solar cell array. An exemplar solar cell in the solar cell array is designated as such. Also disposed on the top of the cube device is a thruster array for providing thrust. An exemplar thruster in the thruster array is designated as such. On opposing sides of the cube device are disposed a data transmitter antenna and a command receiver antenna. On the bottom of the cube are disposed data contacts, power contacts, and heat sink contacts. The cube is protected by a heat shield about the periphery of the cube. A battery is internally disposed in the cube device, preferably near the bottom of the cube device. Above the battery is disposed a fuel container for containing a propellant for use by the thruster array. The container is preferably temperature regulated using a heater. The fuel container includes passive plumbing, such as a wick, for moving the propellant toward the thruster array including the exemplar thruster for providing thrust. The propellant moves towards and to the thrusters by passive plumbing relying upon, for example, capillary action. The thruster array is an array of preferably like micromachined field effect electrostatic propulsion thrusters.

In operation, the solar cell array collects solar energy and provides power to charge the battery for reliable internal power supply to the power converter delivering power to the data processor, command decoder, and device transceiver, as well as the micromachined field effect electrostatic propulsion thruster array. The data processor is used for management operation of the command decoder and device transceiver for receiving commands and transmitting data respectively through the command receiver antenna and the data transmitter antenna. The data processor controls and monitors controlled thrusting action of the thruster array, and indicates the amount and time of thrust provided, and hence, the amount of remaining propellant in the fuel container. The propellant flows preferably by capillary forces to the thrusters. The propellant may be a gallium-based propellant. Power through the device is routed by electronic conducting traces not shown for convenience. While the thrusters are shown with the thruster array on the top of a cube, side placement of the thruster array can be realized for providing side thrusting as desired. The cube design is an exemplar one as other shapes could be used. Placement of antennas, solar cells, electronics, and thrusters can be disposed about the device in various configurations as desired.

The modular microthruster device is essentially an assembled microchip that can conveniently include electronic processors and command receiver chips or processors typically disposed on exterior locations, though internal dispostions may be desirable. The propellant container can be equipped with a heater, as needed, to keep the propellant liquid as environmental conditions require. The propellant wick is a passive propellant acquisition device, such as a screen, that can used as needed. The device shape, such as a cube, can be made on the order of one centimeter on the sides and can be bonded to appropriate spacecraft surface locations where ever directional thrust is desired. The thrust level of a device is determined by the number of microthrusters activated on the assembly face of the device as well as pulse modulation of an accelerating voltage from the power converter while the propellant amount and thus total impulse obtainable is determined by the quantity of propellant stored within the device. The modular shape of the devices is preferably cubical, but different volume and shapes of the device allow for a large range of accumulative thrust and total impulse capabilities distribution on the surfaces of the spacecraft. The modular shapes can be dictated by the most effective propellant wicking or other propellant acquisition means employed. The implementation of the modular device in a cube shape is illustrative only. There are many other possible packaging shapes, and sizes, with various internal details that can accomplish the same modular purpose.

Figure 2:
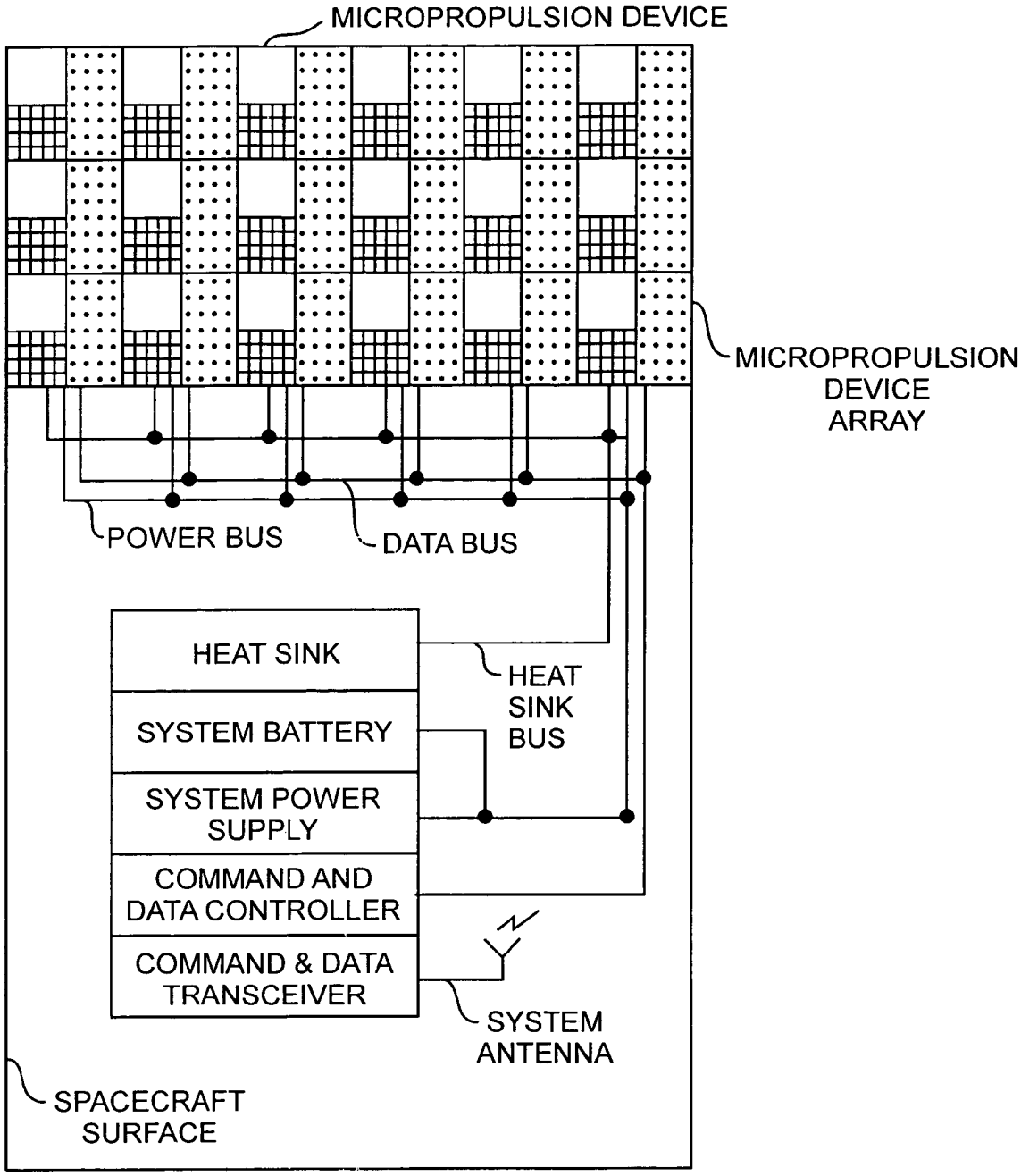
FIG. 2 depicts a modular micropropulsion system.

Referring to FIGS. 1 and 2, the modular micropropulsion system includes a plurality of modular micropropulsion devices preferably aligned in a micropropulsion device array affixed to an exterior spacecraft surface. An exemplar micropropulsion device is designated as such. The system preferably includes a power bus for routing alternative power from a system battery and power supply to the power contacts of the device as power is needed and as an alternative source of power for the device array. The system preferably includes a heat sink bus for transferring waste heat from the device array through heat sink contacts of the device array to a system heat sink. The system preferably includes a data bus for routing command to and data from the device array through data contacts of the device array. The data can indicate the state of the device, including the amount of fuel used and the amount of remaining controlled thrust available from the device of the array of devices. As an alternative method of communication, a command and data transceiver can transmits command to and receive data from the device array using a system antenna communicating through the data transmitter antenna and command receiver antenna of the device array. Beyond solar power, device battery, or system power supply, power to the devices could also be delivered to the devices by electromagnetic propagation through power transmission from the system antenna and collected by the receiving antenna of the devices.

In operation, the system relies upon necessary communications, power supply, and thrusting in an array arrangement. The system has data and command communications through either hard-wire contacts or through electromagnetic propagation using antennas, or both. Power for operating the devices can be from solar cell energy collection or through the system power supply, or both. As more system thrust is desired at various locations of the spacecraft surface, the devices can be disposed in various numbers and at various locations as desired. The preferred form shows only one such arrangement in a square device in a rectangular array arrangement for an exemplar maximum packing densities on a portion of the surface of the spacecraft using the preferred cubical device shape. Further, the shape of an individual device need not necessarily be square as shown, but could also preferably be rectangular, hexangular, triangular, or otherwise to meet various design density and placement requirements about the spacecraft surface.

Micron-sized field effect electrostatic propulsion thrusters are made by micromachining and microchip assembly using conventional manufacturing techniques so that the propulsion thruster gaps are made in the order of micron-sizes and the cube in the order of centimeters. The micromachined field effect electrostatic propulsion thruster device can have any number of different implementation designs and configurations as desired or required. The modular device packaging enables lightweight thrusting in various configurations and in any amount of accumulated directional thrust, well suited for use on small spacecraft. When the total impulse required is much larger than that deliverable by one device for a propulsion application, the requirement can be met by bonding more of the devices to the surface of the spacecraft at appropriate locations desirable for attitude control and translation propulsion of the spacecraft.

The space propulsion systems use arrays of micromachined field effect electrostatic propulsion thruster devices each having an array of thrusters each having a micromachined micron-sized thruster gap to create very large ion accelerating fields with small applied voltages, resulting in thruster devices having a large specific impulse and large thrust simultaneously. The devices can be machined to be small and lightweight. The modularity of the system enables scalability to attain a very large range of thrusts and total impulses without redesigning, redeveloping, or re-testing each device in the array of devices. The ease of supplying power and communications to the devices, together with the complete flexibility of locations for the attained thrust, provides savings in time and man-hours leading to much more affordable spacecraft.

This modular system provides solutions to various propulsion requirements by providing high-accumulated thrust and high specific impulse simultaneously at very low weight and power requirement, using compact self-contained modular thruster devices that can be inexpensively mass-produced. The modular devices include means to deliver electrical power and propellant to the thruster array, and means to receive commands to control the thruster operation with passive plumbing fuel delivery. Coatings and shields can be used to regulate the thermal environment of the devices. Hard wires or antennas can be used in combination to provide power and commands to the devices from a remote or central system controller. Communications means, power delivery means, and fuel containers can be integrated into the modular devices that can then be glued or bonded to the spacecraft surface where needed. Plated wiring or other hard electrical contact means can be routed from the system controller to the devices disposed at various locations in an array on the surface of the spacecraft. A spacecraft surface can use several plated wiring runs so that the devices can be attached where desired on the surface, singly or in numbers, without any redesign of the devices. Power as well as commands also can be sent to the thruster devices via microwave beams from central system antennas to avoid the need for any wiring runs or hardwired contacts. The devices can have receiving antennas built in, plated on, or otherwise disposed as part of the devices. The spacecraft surface is used to support the devices in desired locations to meet specific thrusts needs about the spacecraft.

These modular devices can be attached to the spacecraft surface where ever needed to provide thrust as needed for spacecraft attitude control, or station keeping, or translation. Power and commands are provided along the spacecraft to and at those locations where thrust is known to be required, or, alternatively at many points where the thrust might eventually be required. Command and power delivery to various locations on the surface of the spacecraft can be provided by many wiring points or wiring runs that can be plated or bonded to the surface of the spacecraft in any array configuration. The devices can be made in any desired shape, using wired or wireless transmission of power, command, and data communications. The micromachined field effect electrostatic propulsion thruster devices can be adapted to meet a wide range of spacecraft propulsion needs well suited for small spacecraft, or in aggregation to larger spacecraft. Those skilled in the art can make enhancements, improvements, and modifications to the invention, and these enhancements, improvements, and modifications may nonetheless fall within the spirit and scope of the following claims.

What is claimed is:

1. A device for providing propulsion, the device comprising, an array of thrusters, the array of thrusters being an array of micromachined field effect electrostatic propulsion thrusters, a fuel container containing propellant for producing thrust from the array of thrusters, the fuel container comprising passive plumbing for communicating the propellant to the array of thrusters, and electronics for delivering power to the array of thrusters for generating thrust during ionization and acceleration of the propellant by the array of thrusters, the electronics controlling individually the field effect electrostatic propulsion thrusters of the array of thrusters.

2. The device of claim 1, wherein, the electronics comprises a power converter and a solar cell array for delivering power to the array of thrusters.

3. The device of claim 1 wherein the electronics comprises, a battery for storing electrical power for delivering electrical power to the array of thrusters.

4. The device of claim 1 wherein the electronics comprises, a command decoder for receiving commands to control the array of thrusters, and a data processor for providing data indicating an amount of the propellant available to the array of thrusters.

5. The device of claim 1 wherein, the passive plumbing comprises passive means disposed in the fuel container for drawing the propellant by capillary action from the fuel container to the array of thrusters.

6. The device of claim 1 further comprising, data contacts for routing commands to the device and for routing data from the device, and heat sink contacts for transferring heat from the device to a heat sink.

7. The device of claim 1 further comprising, a data transmitter antenna for transmitting data, a command receiver antenna for receiving commands, and a transceiver for communicating the data to the data transmitter antenna and for receiving the commands from the command receiver.

8. The device of claim 1 further comprising, a heater for maintaining the propellant in a liquid state.

9. The device of claim 1 wherein, the device is a modular device, and the device has a modular shape of any solid shape containing at least one surface for supporting the array of thrusters.

10. A system for providing thrust on a spacecraft having a surface, the system comprising, a controller for providing commands, devices, the devices being modular propulsion devices disposed in an array on the surface, each of the devices comprises:

an array of thrusters, the array of thrusters being an array of field effect electrostatic propulsion thrusters, each of the field effect electrostatic propulsion thrusters are micromachined thrusters;

a fuel container containing propellant for producing thrust from the array of thrusters, the fuel container comprising passive plumbing for communicating the propellant to the array of thrusters; and electronics for delivering power to the array of thrusters for generating thrust during ionization and acceleration of the propellant by the array of thrusters, the electronics controlling the field effect electrostatic propulsion thrusters of the array of thrusters, the electronics for receiving commands from the controller, the devices being disposed in an array about and on the surface of the spacecraft.

11. The system of claim 10 wherein the electronics comprise, a power converter, a solar cell array for delivering power the array of thrusters, and, a battery for storing solar energy from the solar cell array and through the power converter and for delivering power to the array of thrusters.

12. The system of claim 10 wherein the electronics comprises, a command decoder for receiving commands from the controller to control the array of thrusters, and a data processor for providing data indicating a state of the array of thrusters.

13. The system of claim 10 wherein the passive plumbing comprises a passive means disposed in the fuel container for drawing the propellant by capillary action from the fuel container to the array of thrusters.

14. The system of claim 10 wherein, each of the devices further comprises a contact for routing commands from the controller to the device and for routing data from the device to the controller.

15. The system of claim 10 further comprising, a heat sink receiving waste heat from the devices, each of the devices is coupled to the heat sink for transferring heat from the devices to the heat sink.

16. The system of claim 10 wherein the controller comprises a command and data controller for generating commands to the devices and processing data from the devices, the controller comprises a command and data transceiver for communicating the commands and data, and the controller comprises a system antenna for communicating commands to the devices and for receiving data from the devices, and wherein, the electronics comprises: a command decoder for receiving the commands from the controller to control the array of thrusters; a data processor for providing data communicated to the controller for indicating a state of the array of thrusters; a data transmitter antenna for transmitting the data; a command receiver antenna for receiving the commands; and a transceiver for communicating the data to the data transmitter antenna and for receiving the commands from the command receiver.

17. The system of claim 10 further wherein, each of the devices comprises a heater for maintaining the propellant in a liquid state.

18. The system of claim 10 wherein, the devices are in a shape selected from the group consisting of cubes, squares, rectangles, hexagons, and triangles comprising at least one planar surface for supporting the array of thrusters, and the devices are micromachined devices.

19. The system of claim 10 wherein, the controller comprises a system battery for delivering power to the devices.

20. The system of claim 10 wherein, the controller comprises a system antenna for propagating an electromagnetic beam, and the devices comprise a device antenna for receiving the electromagnetic beam for providing power to the devices.

* * * * *